US011549333B2

(12) United States Patent
Brown et al.

(10) Patent No.: US 11,549,333 B2
(45) Date of Patent: Jan. 10, 2023

(54) INDEXING TOOL SYSTEM FOR A RESOURCE EXPLORATION AND RECOVERY SYSTEM

(71) Applicants: Donavan Holland Brown, Houston, TX (US); Hai Hoang Nguyen, Houston, TX (US); Kyle Henagan, Spring, TX (US)

(72) Inventors: Donavan Holland Brown, Houston, TX (US); Hai Hoang Nguyen, Houston, TX (US); Kyle Henagan, Spring, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/488,447

(22) Filed: Sep. 29, 2021

(65) Prior Publication Data

US 2022/0136368 A1 May 5, 2022

Related U.S. Application Data

(60) Provisional application No. 63/107,653, filed on Oct. 30, 2020.

(51) Int. Cl.
*E21B 34/08* (2006.01)
*E21B 17/10* (2006.01)
(Continued)

(52) U.S. Cl.
CPC ..... *E21B 34/08* (2013.01); *E21B 17/1057* (2013.01); *E21B 23/006* (2013.01);
(Continued)

(58) Field of Classification Search
CPC ..... E21B 23/006; E21B 34/06; E21B 34/14; E21B 2200/02
See application file for complete search history.

(56) References Cited

U.S. PATENT DOCUMENTS 6,634,424 B2 * 10/2003 Knowles ..... E21B 23/006 74/88
9,234,406 B2 * 1/2016 Naedler ..... E21B 43/14
(Continued)

FOREIGN PATENT DOCUMENTS

WO 2009025977 A1 2/2009

OTHER PUBLICATIONS

International Search Report and Written Opinion for International Application No. PCT/US2021/056233; International Filing Date Oct. 22, 2021; Report dated Feb. 15, 2022 (pp. 1-9).

*Primary Examiner* — Jonathan Malikasim
(74) *Attorney, Agent, or Firm* — Cantor Colburn LLP

(57) ABSTRACT

An indexing valve system includes a tubular having an inner surface portion defining a passage portion, a first plurality of indexing components provided on the inner surface and a second plurality of indexing components provided on the inner surface portion. A valve sleeve is arranged in the passage portion. The valve sleeve includes a first plurality of indexing elements that selectively engage with the first plurality of indexing components, a second plurality of indexing elements that selectively engage with the second plurality of indexing components, and an inner surface section defining a passage section. The inner surface section includes a plurality of indexing step members. An insert extends into the passage section. The insert includes an outer surface supporting an indexer that selectively engages with the plurality of indexing step members to shift the valve
(Continued)

sleeve between the first plurality of indexing components and the second plurality of indexing components.

20 Claims, 17 Drawing Sheets

(51) Int. Cl.
*E21B 23/00* (2006.01)
*E21B 34/06* (2006.01)
*E21B 34/14* (2006.01)

(52) U.S. Cl.
CPC ..... *E21B 34/06* (2013.01); *E21B 34/14* (2013.01); *E21B 2200/02* (2020.05)

(56) References Cited

U.S. PATENT DOCUMENTS

| | | | | |
|---|---|---|---|---|
| 9,752,412 | B2 * | 9/2017 | Shkurti | E21B 23/006 |
| 9,822,608 | B2 * | 11/2017 | Avant | E21B 34/14 |
| 10,125,575 | B2 * | 11/2018 | Manera | E21B 23/006 |
| 10,428,609 | B2 * | 10/2019 | Farrar | E21B 23/006 |
| 2014/0138101 | A1 * | 5/2014 | Arabsky | E21B 33/12 166/387 |
| 2016/0245043 | A1 | 8/2016 | Naedler et al. | |
| 2016/0298420 | A1 | 10/2016 | Shkurti et al. | |
| 2017/0370168 | A1 | 12/2017 | Farrar et al. | |
| 2021/0340863 | A1 * | 11/2021 | Brown | E21B 47/12 |

* cited by examiner

INDEXING TOOL SYSTEM FOR A RESOURCE EXPLORATION AND RECOVERY SYSTEM

CROSS-REFERENCE TO RELATED APPLICATIONS

This application claims the benefit of U.S. Provisional Patent Application No. 63/107,653, filed Oct. 30, 2020, the contents of which are incorporated by reference herein in their entirety.

BACKGROUND

In the resource exploration and recovery industry, boreholes may be formed in a resource bearing formation. A casing may be extended into the resource bearing formation. A tubular may then be extended into the casing. The resource bearing formation may include various zones of interest. Seals or packers may be deployed from the tubular outwardly against the casing to isolate one zone of interest from another. At this point, the casing may be selectively perforated in order to introduce fluids from the tubular into the formation or vice-versa.

Treatment fluids may flow into the formation through valves provided in the tubular. Similarly, valves may be selectively positioned to allow formation fluids to pass into the tubular from the formation. There are various actuation mechanisms for operating downhole valves. One system involves the use of a pin and j-slot assembly. The pin and j-slot assembly relies on the use of multiple separate and distinct components including a j-sleeve and a bearing sleeve internal to a valve's housing to provide a j-slot track that facilitates movement between valve positions. The multiple separate and distinct components add to an overall cost and complexity of the actuation mechanism. Further, the use of j-slot tracks imposes a length requirement on the valve. The art would be appreciative of a valve having fewer components and may be made without j-tracks and thus allow for the construction of a more compact valve.

SUMMARY

Disclosed is an indexing valve system including a tubular having an outer surface portion, an inner surface portion defining a passage portion, a first plurality of indexing components provided on the inner surface and a second plurality of indexing components provided on the inner surface spaced from the first plurality of indexing components, an opening extending through the tubular. A valve sleeve is arranged in the passage portion between the first plurality of indexing components and the second plurality of indexing components. The valve sleeve includes a first end having a first plurality of indexing elements that selectively engage with the first plurality of indexing components, a second end including a second plurality of indexing elements that selectively engage with the second plurality of indexing components, and an inner surface section defining a passage section. The inner surface section including a plurality of indexing step members. A valve opening extends through the valve sleeve. An insert extends into, and is axially shiftable relative to, the passage section. The insert includes an outer surface supporting an indexer that selectively engages with the plurality of indexing step members to shift the valve sleeve between the first plurality of indexing components and the second plurality of indexing components to selectively position the valve opening relative to the opening in the tubular.

Also disclosed is a resource exploration and recovery system including a surface system and a sub-surface system including a tubular string extending from the surface system. The tubular string includes an indexing valve system including a tubular having an outer surface portion, an inner surface portion defining a passage portion, a first plurality of indexing components provided on the inner surface and a second plurality of indexing components provided on the inner surface spaced from the first plurality of indexing components, an opening extending through the tubular. A valve sleeve is arranged in the passage portion between the first plurality of indexing components and the second plurality of indexing components. The valve sleeve includes a first end having a first plurality of indexing elements that selectively engage with the first plurality of indexing components, a second end including a second plurality of indexing elements that selectively engage with the second plurality of indexing components, and an inner surface section defining a passage section. The inner surface section including a plurality of indexing step members. A valve opening extends through the valve sleeve. An insert extends into, and is axially shiftable relative to, the passage section. The insert includes an outer surface supporting an indexer that selectively engages with the plurality of indexing step members to shift the valve sleeve between the first plurality of indexing components and the second plurality of indexing components to selectively position the valve opening relative to the opening in the tubular.

Further disclosed is a method of selectively opening a valve in a tubular, the method including shifting an insert into a passage portion of a tubular, guiding the insert into a valve sleeve disposed in the passage portion, engaging an indexer on the insert with one of a plurality of indexing step members in the valve sleeve, shifting the valve sleeve in a first direction with the insert toward a first plurality of indexing components in the tubular, rotating the valve sleeve a first distance through inter-engagement of a first plurality of indexing elements on the valve sleeve with the first plurality of indexing components, shifting the valve sleeve in a second, opposing direction toward a second plurality of indexing elements in the tubular, engaging the second plurality of indexing elements on the valve sleeve with the second plurality of indexing components, and further rotating the valve sleeve by engaging the second plurality of indexing elements with the second plurality of indexing components.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
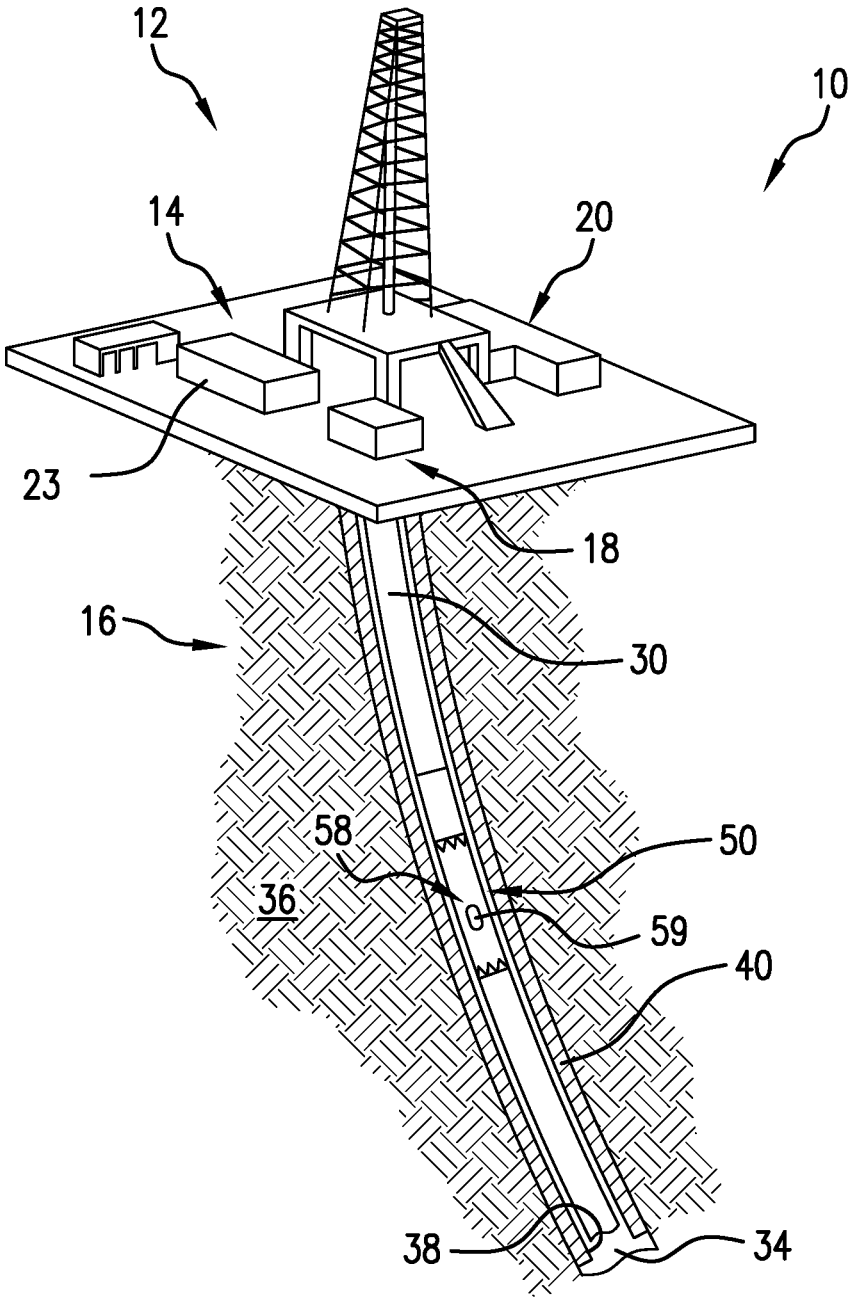
FIG. 1 depicts a resource exploration and recovery system including an indexing tool system, in accordance with an aspect of an exemplary embodiment.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 12 which, in some environments, may take the form of a surface system 14 operatively and fluidically connected to a second system 16 which, in some environments, may take the form of a subsurface system.

First system 12 may include pumps 18 that aid in completion and/or extraction processes as well as fluid storage 20. Fluid storage 20 may contain a stimulation fluid which may be introduced into second system 16. First system 12 may also include a control system 23 that may monitor and/or activate one or more downhole operations. Second system 16 may include a tubular string 30 formed from one or more tubulars (not separately labeled) that is extended into a wellbore 34 formed in formation 36. Wellbore 34 includes an annular wall 38 that may be defined by a casing tubular 40 that extends from first system 12 into second system 16.

Figure 2:
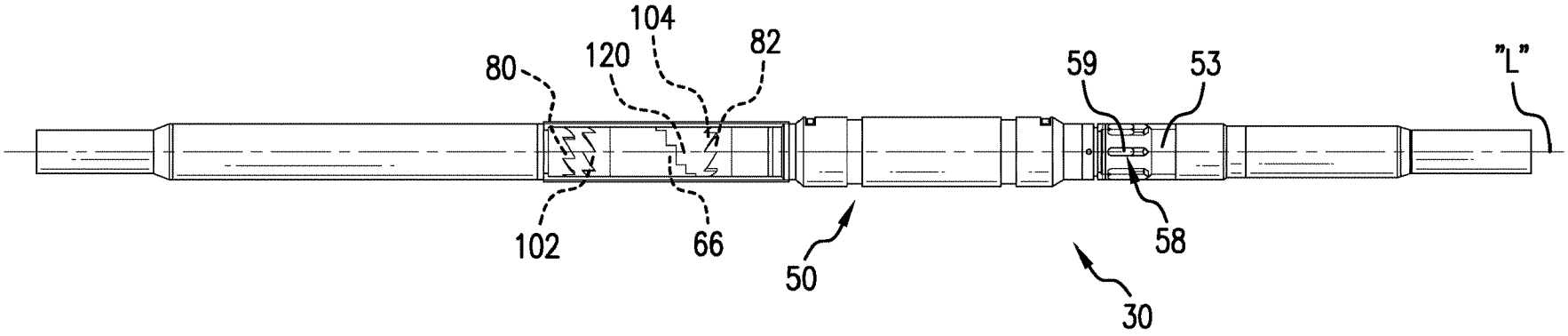
FIG. 2 depicts a partial glass view of the indexing tool system, in accordance with an exemplary embodiment.
Figure 3:
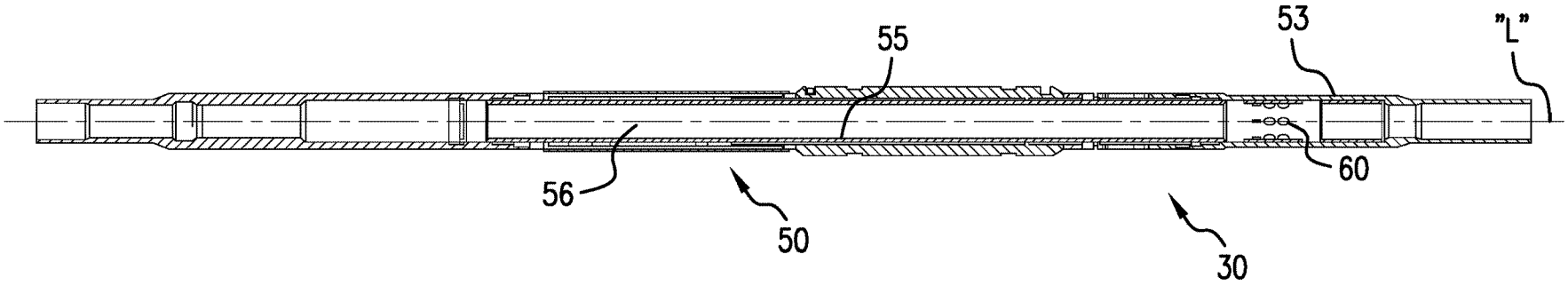
FIG. 3 depicts a cross-sectional side view of the indexing tool system of FIG. 2 in accordance with an exemplary embodiment.
Figure 4:
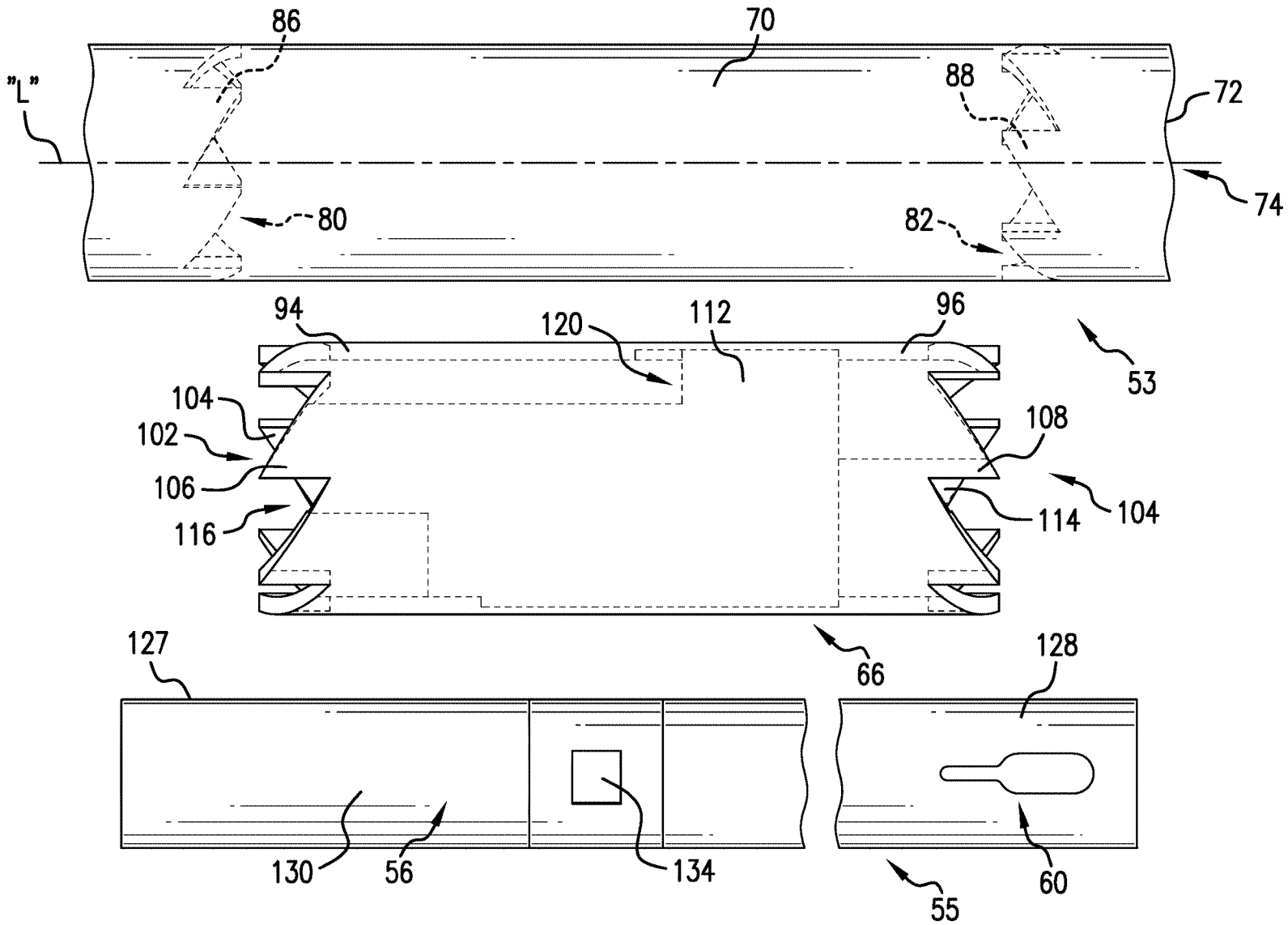
FIG. 4 depicts a dissembled view of a portion of the indexing tool system, in accordance with an exemplary aspect

In accordance with an exemplary aspect, tubular string 30 supports an indexing tool system 50. Referring to FIGS. 2-4, indexing tool system 50 includes an outer tubular 53 and an inner tubular 55 that takes the form of an insert 56. Outer tubular 53 includes a flow port 58, shown in the form of an opening 59. Inner tubular 55 includes an opening 60 that is selectively aligned with flow port 58. Thus, in the embodiment shown, indexing tool 50 takes the form of an indexing valve. However, it should be understood that indexing tool 50 may take on a variety of forms including tools that may benefit from incremental changes in length and/or rotational position.

In an embodiment, flow port 58 and opening 60 take the form of non-circular elongated openings having varying dimensions. Outer tubular 53 and insert 56 extend along a longitudinal axis "L". Referring to FIG. 4, an indexing sleeve 66 is positioned about insert 56. As will be detailed herein, indexing sleeve 66 transitions along longitudinal axis "L" in order to incrementally, selectively, axially align flow port 58 and opening 60.

With continues reference to FIG. 4, outer tubular 53 includes an outer surface portion 70 and an inner surface portion 72 that defines a passage portion 74. A first plurality of indexing components 80 extend radially inwardly from inner surface portion 72. A second plurality of indexing components 82 extend radially inwardly from inner surface 72 and is spaced from first plurality of indexing components 80 along longitudinal axis "L". First plurality of indexing components 80 may take the form of a first annular array of tooth components 86 while second plurality of indexing components 82 take the form of a second annular array of tooth components 88. Second annular array of tooth components 88 is circumferentially offset relative to second annular array of tooth components 86.

Figure 5:
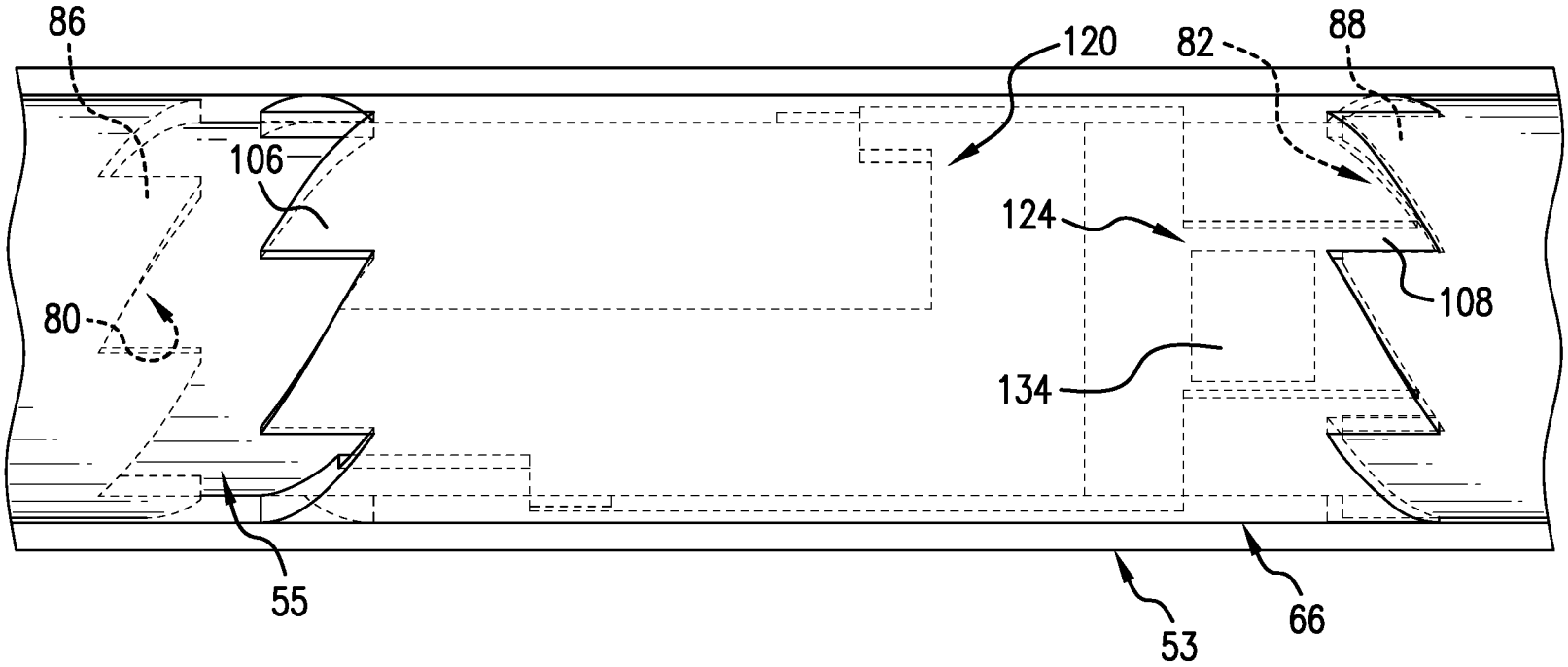
FIG. 5 depicts a glass view of the indexing tool system showing an indexer mounted to an insert moving into a tool sleeve positioned in a tubular, in accordance with an aspect of an exemplary embodiment.

With continued reference to FIG. 4, indexing sleeve 66 includes a first end 94 and an opposing second end 96. First end 94 includes a first plurality of indexing elements 102 and second end 96 includes a second plurality of indexing elements 104. First plurality of indexing elements 102 take the form of a first annular array of tooth elements 106 and second plurality of indexing elements 104 take the forth of a second annular array of tooth elements 108. First annular array of tooth elements 106 is configured to engage with first annular array of tooth components 86. Similarly, second annular array of tooth elements 108 is configured to engage with second annular array of tooth components 88. Indexing sleeve 66 also includes an outer surface section 112 and an inner surface section 114 that defines a passage section 116. A plurality of axially offset indexing step members 120 are formed in inner surface section 114 as shown in, for example, FIG. 5. A passage 124 extends through axially offset indexing step members 120.

In an embodiment, insert 56 extends into passage section 116. Insert 56 includes a first end 127, a second end 128, and an outer surface 130 supporting an indexer 134. Opening 60 extends through outer surface 130 and is spaced from second end 128. In an embodiment, indexer 134 includes a generally rectangular shape and extends radially outwardly of outer surface 130. Insert 56 is rotationally constrained yet generally rectangular geometry axially shiftable in passage section 116 so that indexer 134 may selectively act upon the plurality of axially offset indexing step members 120 to slidably and rotatably shift and position indexing sleeve 66 within passage portion 74 in order to selectively align valve opening 60 with flow port 58 as will be detailed herein.

Figure 6:
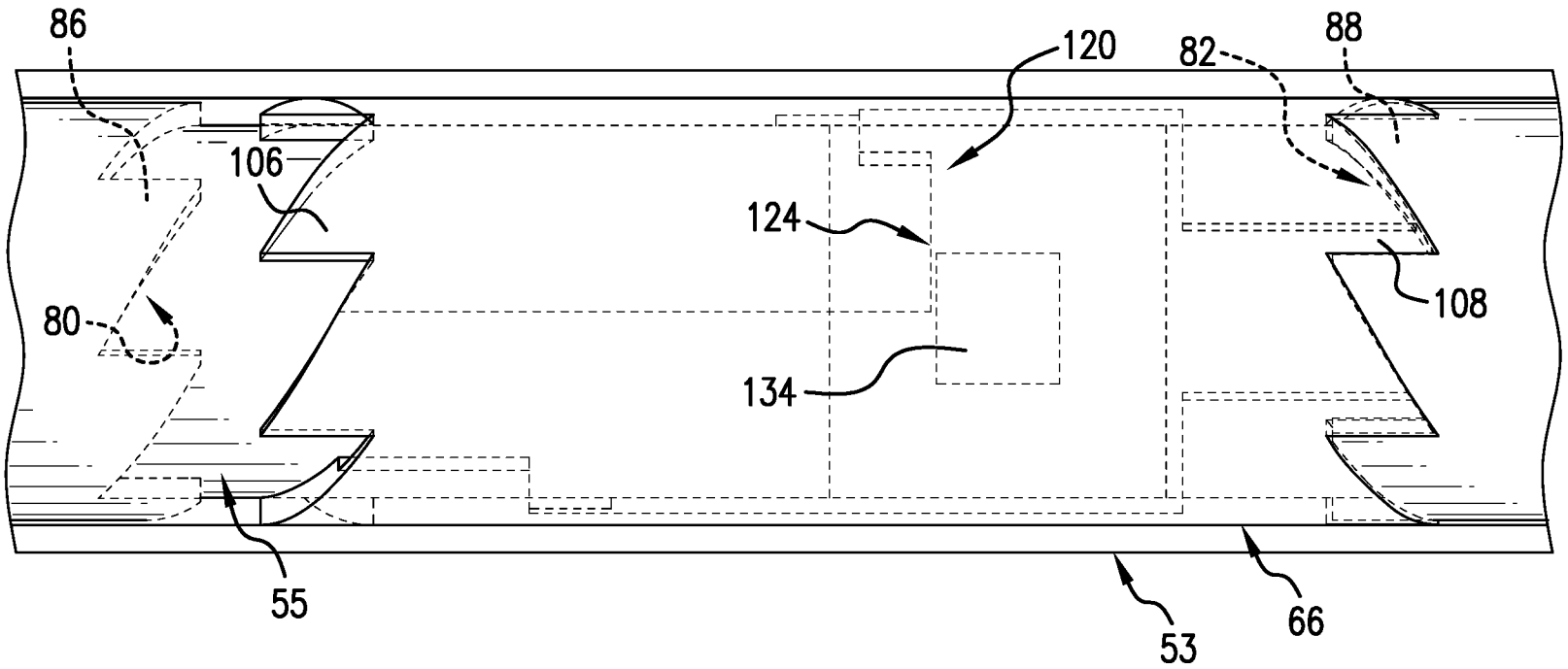
FIG. 6 depicts a glass view of the indexing tool system showing the indexer engaging with an indexing step member, in accordance with an aspect of an exemplary embodiment.
Figure 7:
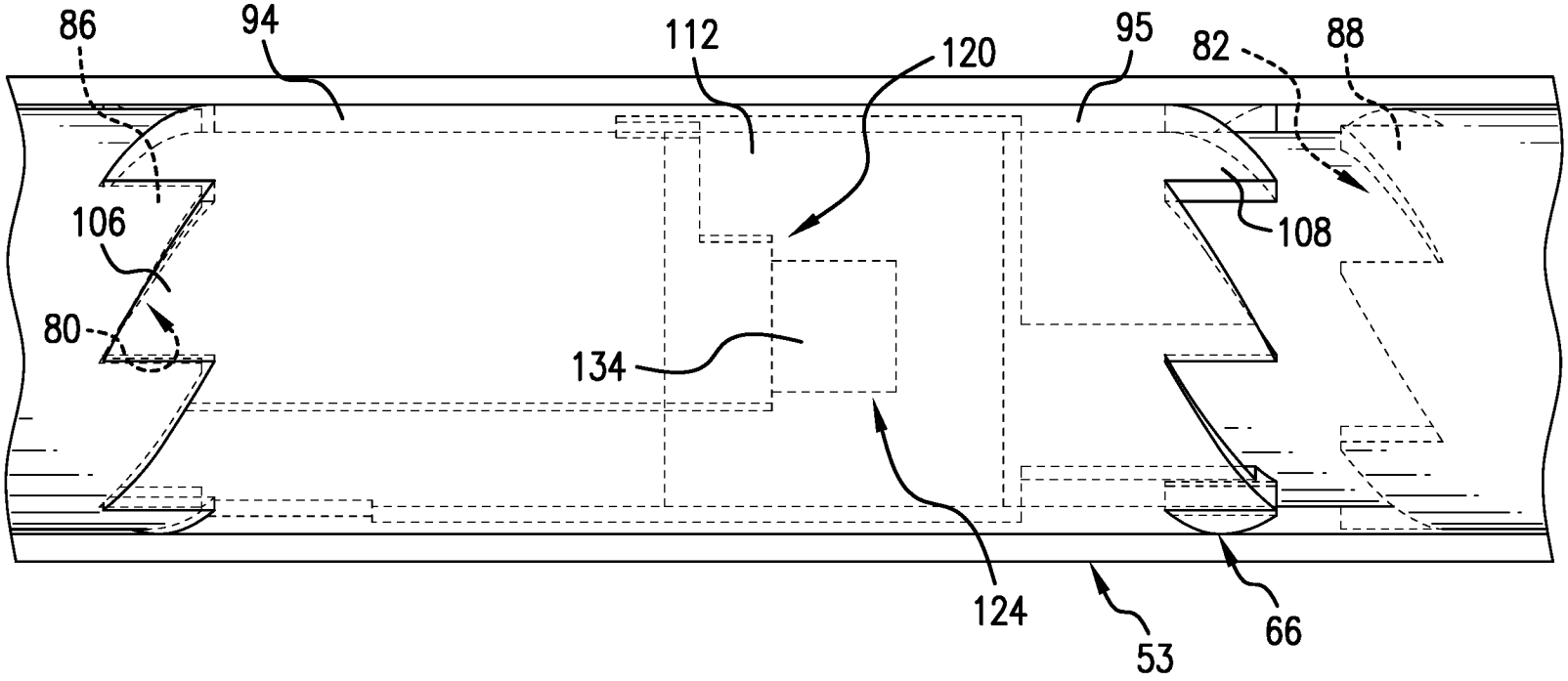
FIG. 7 depicts a glass view of the indexing tool system showing a first plurality of indexing elements on the tool sleeve engaging with a first plurality of indexing components in the tubular, in accordance with an aspect of an exemplary embodiment.
Figure 8:
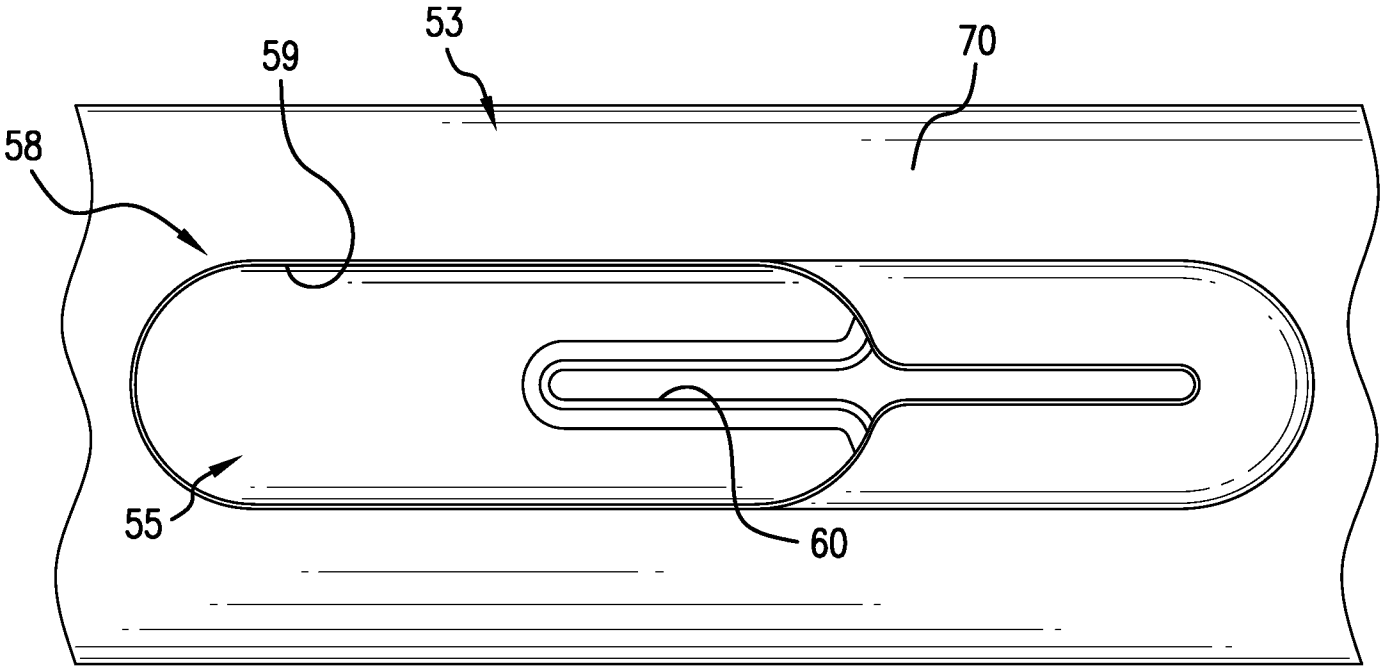
FIG. 8 depicts an opening formed in the insert partially exposed through an opening in the tubular, in accordance with an aspect of an exemplary embodiment.

Referring to FIGS. 5-8, insert 56 is guided into passage section 116 such that indexer 134 aligns with and passes through passage 124 as shown in FIG. 3. Insert 56 is guided along longitudinal axis "L" until indexer 134 contacts one of axially offset indexing step members 120 as shown in FIG. 6. Insert 56 is shifted further along longitudinal axis "L" such that indexer 134 pushes indexing sleeve 66 toward first plurality of indexing components 80 as shown in FIG. 7. First plurality of indexing elements 102 engage with first plurality of indexing components 80 such that a first choking position is set as shown in FIG. 8. That is, in the first choking position, opening 60 is set in a first position relative to flow port 58.

Figure 9:
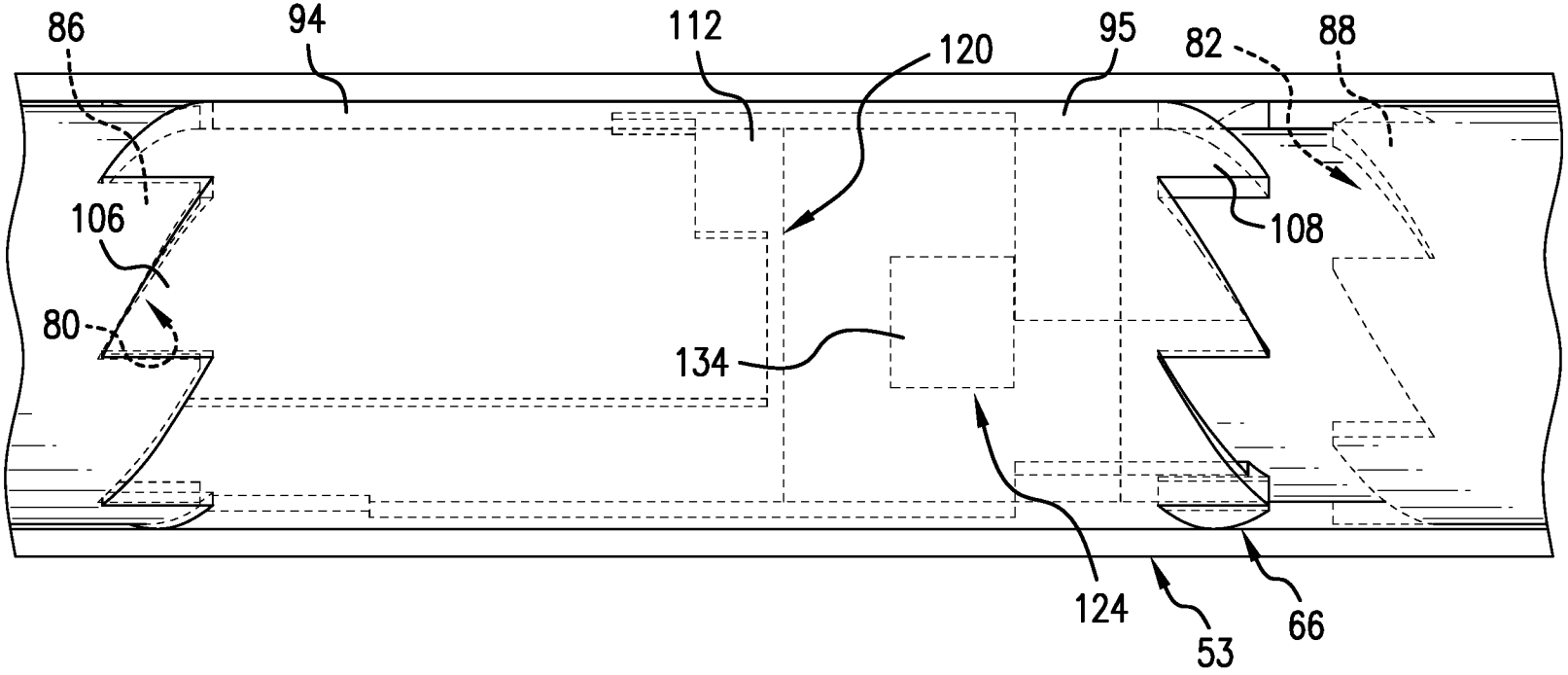
FIG. 9 depicts a glass view of the indexing tool system showing the indexer moving the tool sleeve toward a second plurality of indexing components in the tubular, in accordance with an aspect of an exemplary embodiment.
Figure 10:
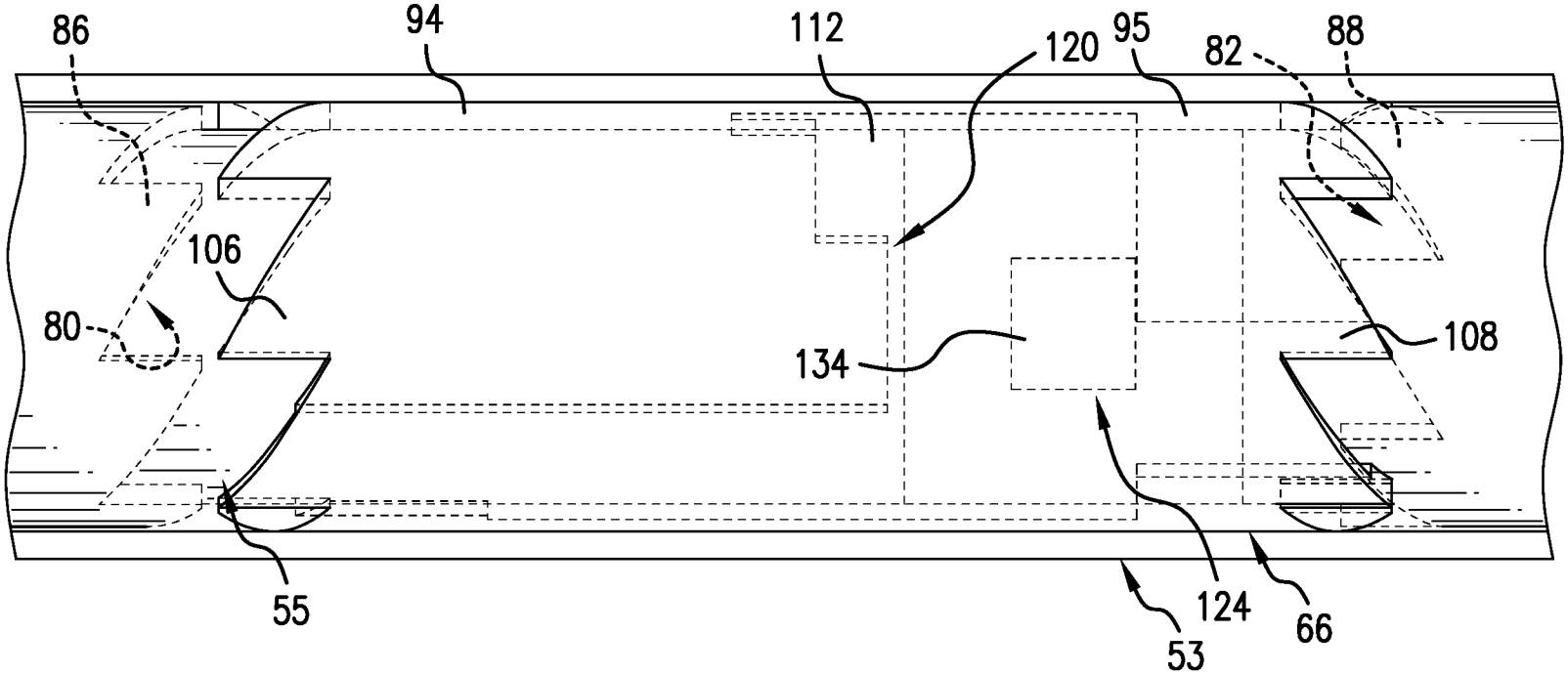
FIG. 10 depicts a glass view of the indexing tool system showing a second plurality of indexing elements on the tool sleeve engaging with the second plurality of indexing components, in accordance with an aspect of an exemplary embodiment.
Figure 11:
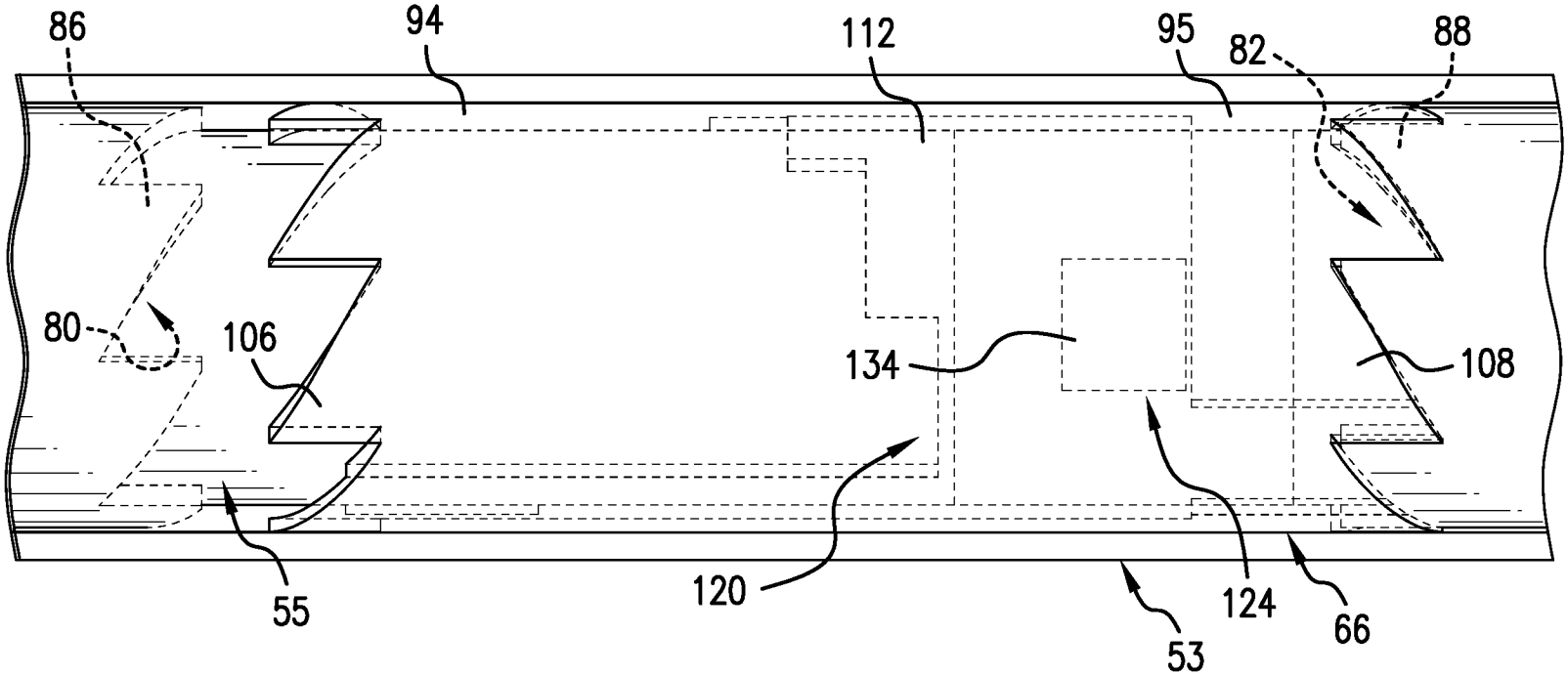
FIG. 11 depicts a glass view of the indexing tool system showing the tool sleeve rotating due to an interaction between the second plurality of indexing elements and the second plurality of indexing components, in accordance with an aspect of an exemplary embodiment.
Figure 12:
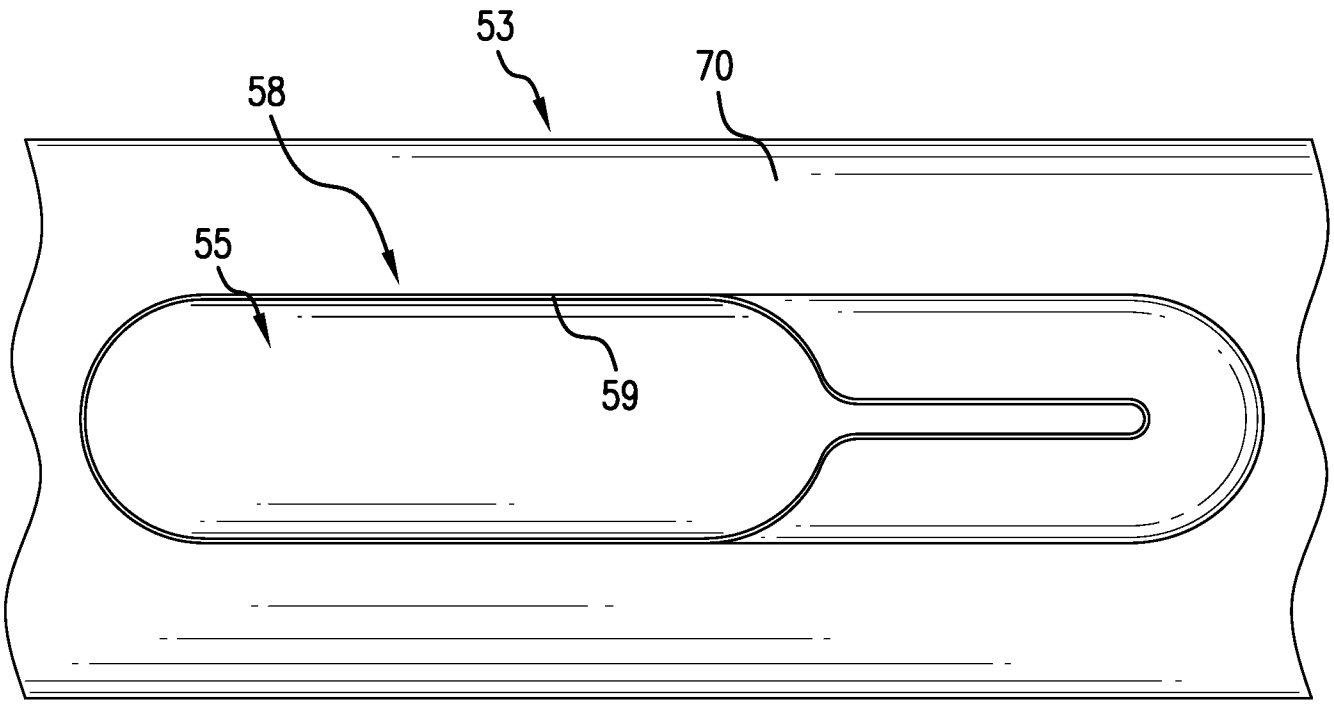
FIG. 12 depicts the opening in the insert being axially offset relative to the opening in the tubular, in accordance with an aspect of an exemplary embodiment.

If a different choking position is desired, insert 56 is shifted in a second, opposing direction, such that indexer 134 engages and pushes indexing sleeve 66 toward second plurality of indexing components 82 as shown in FIG. 9. Insert 56 is further shifted such that second plurality of tooth elements 104 engages with second plurality of tooth components 88 as shown in FIG. 10. Continued shifting of insert 56 causes indexing sleeve 66 to begin to rotate due to an interaction between angled surfaces on corresponding ones of second plurality of tooth elements 104 and second plurality of tooth components 88 as shown in FIG. 11. When fully engaged, insert 56 is positions such that outer tubular 53 covers opening 60 as shown in FIG. 12 closing off any flow passing out from the indexing valve.

Figure 13:
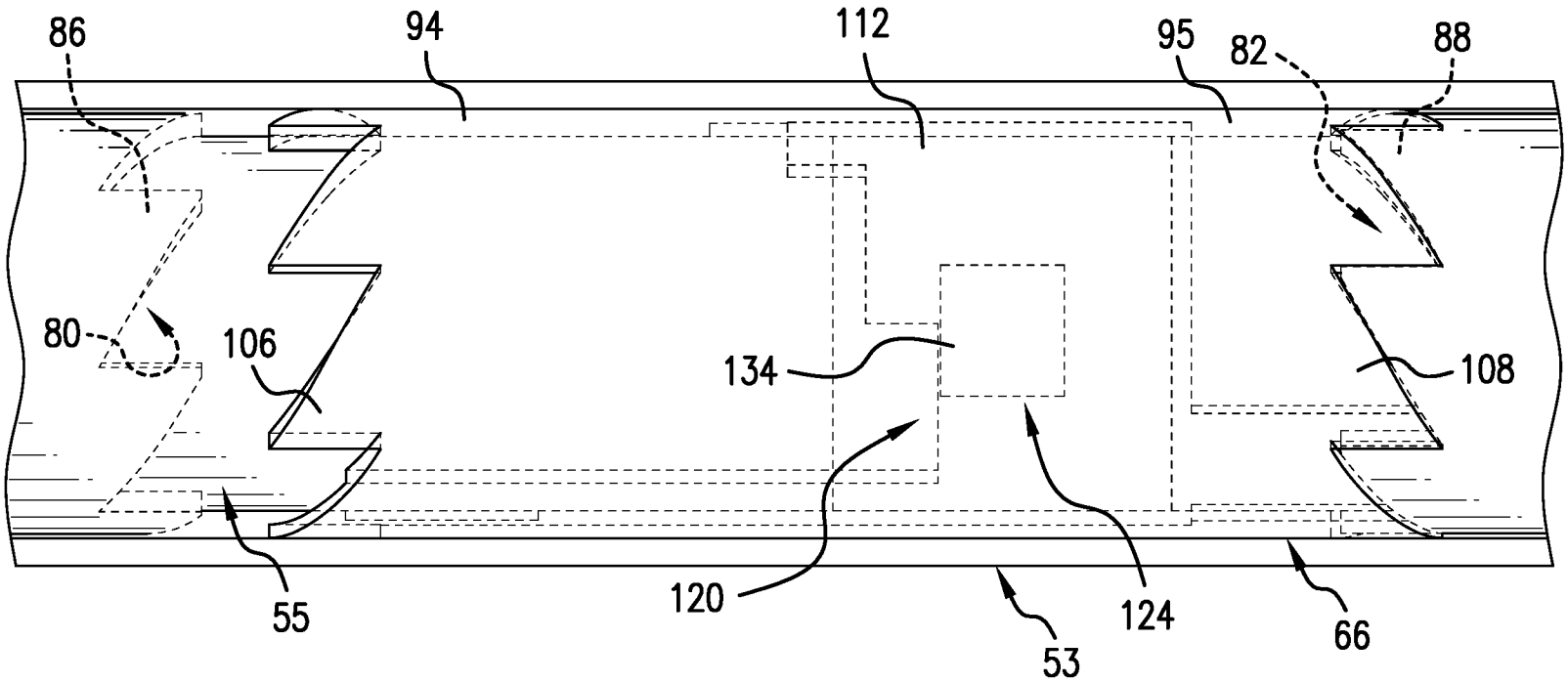
FIG. 13 depicts a glass view of the indexing tool system showing the indexer moving the tool sleeve back toward the second plurality of indexing components in the tubular, in accordance with an aspect of an exemplary embodiment.
Figure 14:
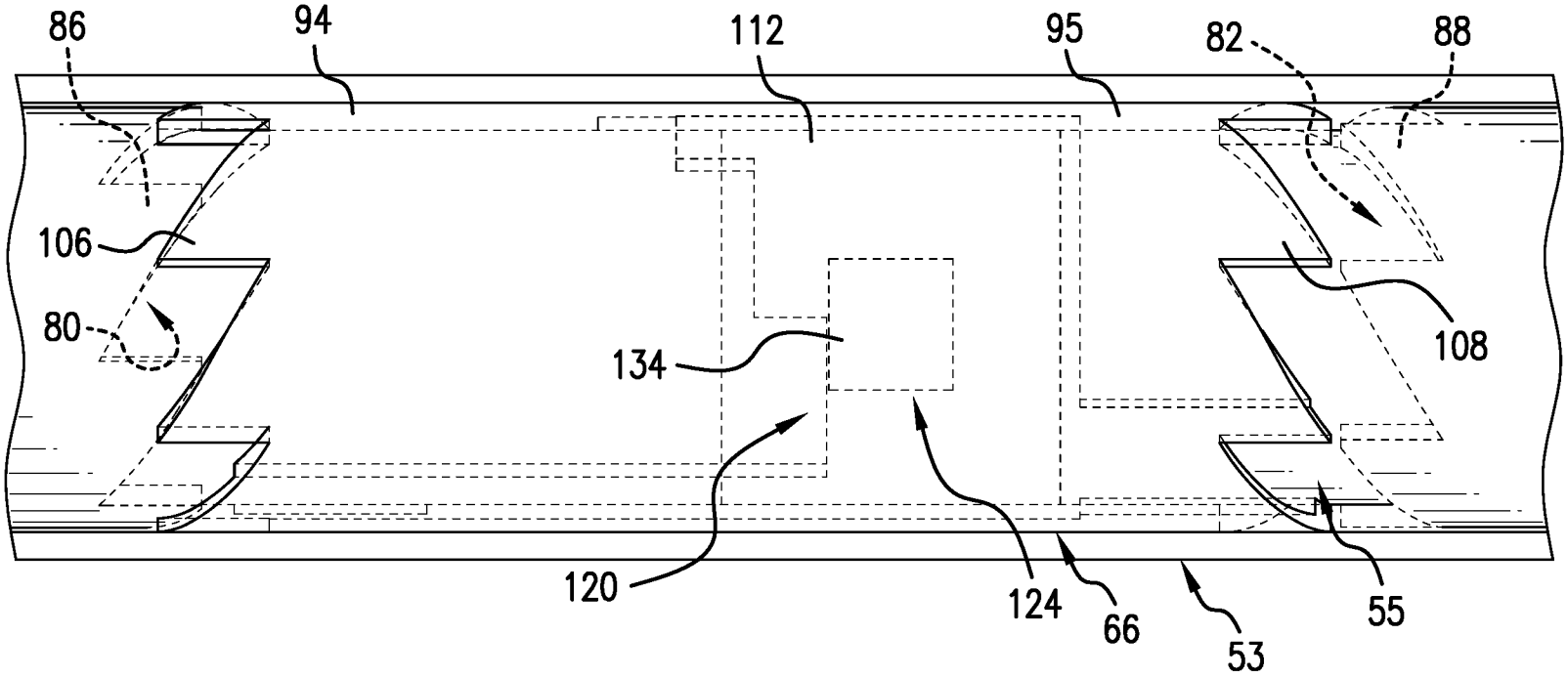
FIG. 14 depicts a glass view of the indexing tool system showing the first plurality of indexing elements on the tool sleeve engaging with the first plurality of indexing components, in accordance with an aspect of an exemplary embodiment.
Figure 15:
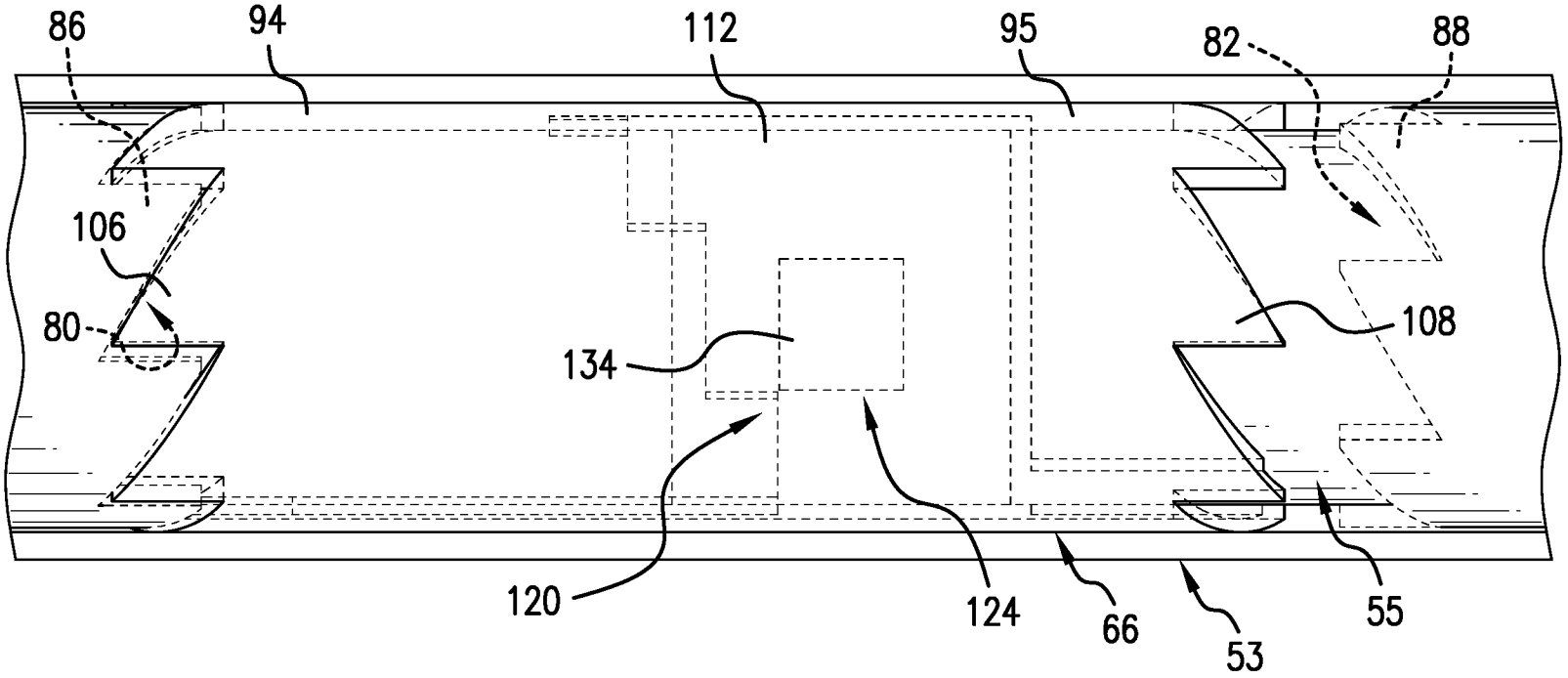
FIG. 15 depicts a glass view of the indexing valve system showing the tool sleeve beginning to rotate due to an interaction between the first plurality of indexing elements and the first plurality of indexing components, in accordance with an aspect of an exemplary embodiment.

If it is desired to further open flow port 58, insert 56 is shifted back along longitudinal axis "L" as shown in FIG. 13 to re-engage with the one of the plurality of axially offset indexing step members 120. Insert 56 is further shifted such that indexer 134 pushes against the one of the plurality axially offset indexing of step members 120 causing the first plurality of indexing elements 102 to re-engage with the first plurality of indexing components 80 as shown in FIG. 14. As the first plurality of indexing elements 102 re-engage with the first plurality of indexing components 80, angled surfaces (not separately labeled) on each of the plurality of indexing elements 102 slide along angled surfaces of each of the first plurality of indexing components 80 causing indexing sleeve 66 to rotate as shown in FIG. 15.

Figure 16:
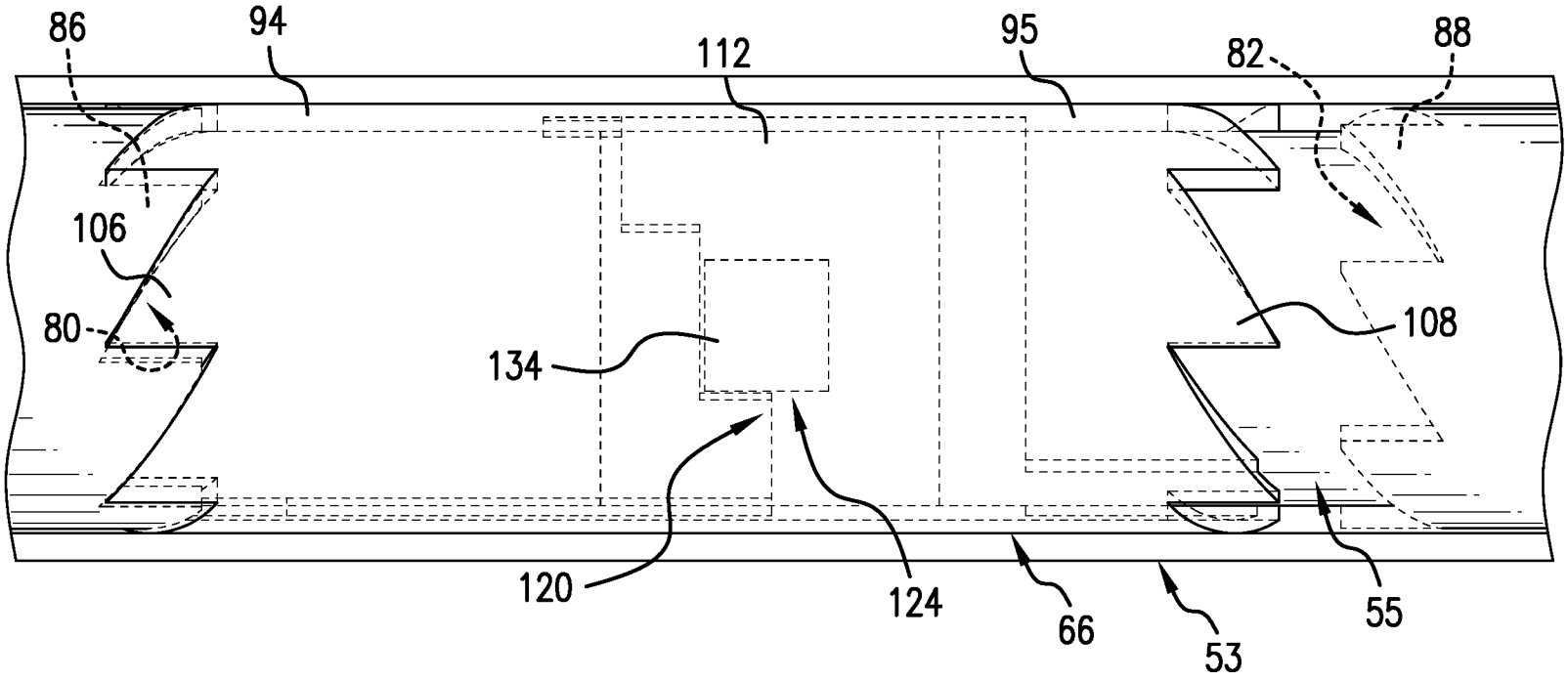
FIG. 16 depicts a glass view of the indexing tool system showing the indexing member nesting into another of the indexing step members, in accordance with an aspect of an exemplary embodiment.
Figure 17:
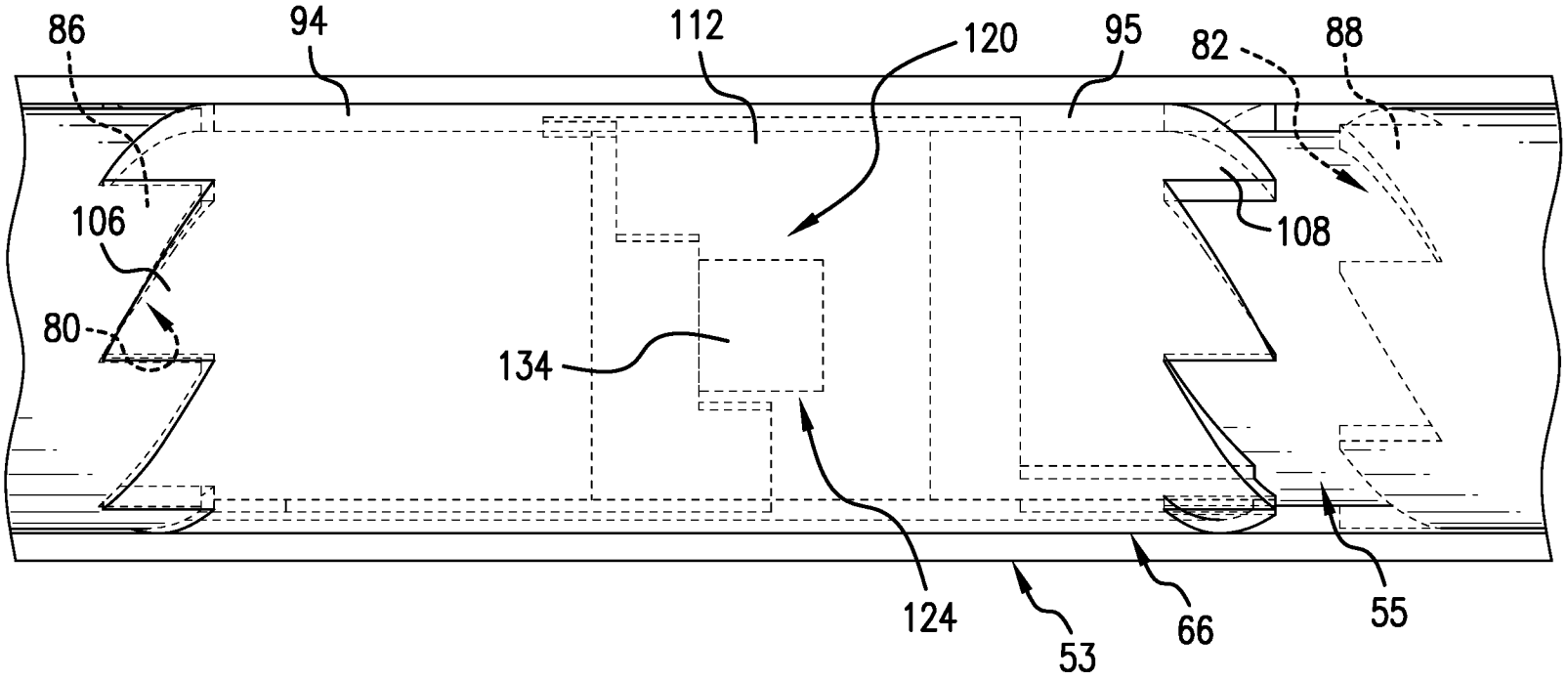
FIG. 17 depicts a glass view of the indexing tool system showing the tool sleeve fully engaging with the first plurality of indexing components, in accordance with an aspect of an exemplary embodiment.
Figure 18:
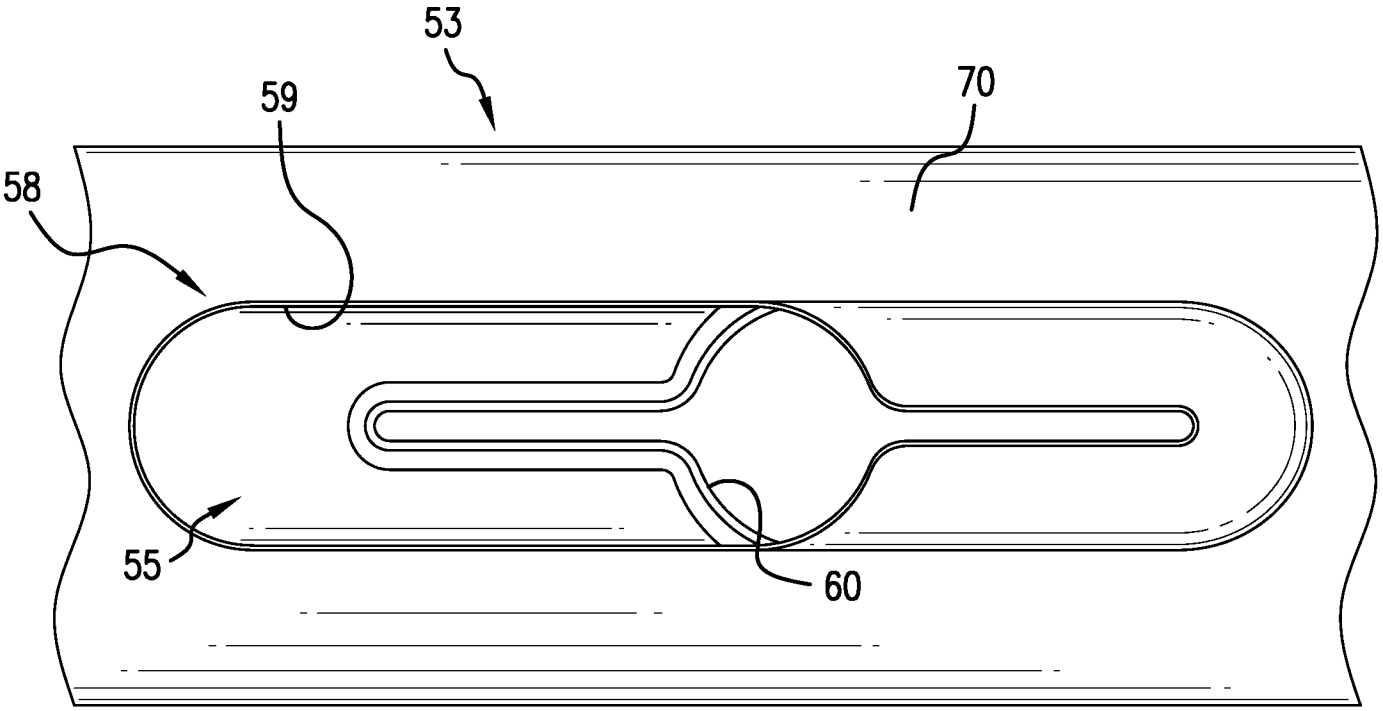
FIG. 18 depicts the opening in the insert further registering with the opening in the tubular, in accordance with an aspect of an exemplary embodiment.

The rotation of indexing sleeve 66 causes indexer to unseat from the one of the plurality axially offset indexing step members 120. At this point, insert 56 shifts indexer 134 further along longitudinal axis "L" into engagement with another of the plurality of axially offset indexing step members 120 as shown in FIG. 16. Indexing sleeve 66 is further shifted by insert 56 until first plurality of indexing elements 102 fully engages with the first plurality of indexing components 80 as shown in FIG. 17. Once fully engaged, insert 56 shifts further causing opening 60 to move further across flow port 58 creating a new, larger, choking position as shown in FIG. 18.

At this point, it should be understood that additional reciprocating motion of insert 56 within passage section 116 will result in further incremental rotation of indexing sleeve 66 causing different ones of axially offset indexing step members 120 to align and engage with indexer 134. With each partial rotation of indexing sleeve 66, a different axially offset indexing step member 120 is engaged by indexer 134. Progressing around inner surface section 114 of indexing sleeve 66, each axially offset indexing step member 120 allows insert 56 to move axially further into outer tubular 53 resulting in a different degree of axial alignment of opening 60 relative to flow port 58. The differing degree of axial alignment results in an incrementally larger degree of exposure of opening 60 through flow port 58.

Incrementally changing the amount of exposure of opening 60 creates different choke settings that control a rate of fluid flow into or out from the indexing valve. A complete rotation of indexing sleeve 66 causes opening 60 to be once again fully covered by outer tubular 53. By constraining rotation of insert 56, and employing indexing components/elements as discussed, an overall length of indexing tool system 50 may be reduced over that which is currently available. At this point, it should be understood that while described in terms of incrementally opening a valve, the exemplary embodiment may be employed to incrementally close an opening or incrementally axially move any member relative to another member for various purposes.

Set forth below are some embodiments of the foregoing disclosure:

Embodiment 1. An indexing valve system comprising: a tubular including an outer surface portion, an inner surface portion defining a passage portion, a first plurality of indexing components provided on the inner surface and a second plurality of indexing components provided on the inner surface portion spaced from the first plurality of indexing components, an opening extending through the tubular; a valve sleeve arranged in the passage portion between the first plurality of indexing components and the second plurality of indexing components, the valve sleeve including a first end having a first plurality of indexing elements that selectively engage with the first plurality of indexing components, a second end including a second plurality of indexing elements that selectively engage with the second plurality of indexing components, and an inner surface section defining a passage section, the inner surface section including a plurality of indexing step members, a valve opening extends through the valve sleeve; and an insert extending into, and being axially shiftable relative to, the passage section, the insert including an outer surface supporting an indexer that selectively engages with the plurality of indexing step members to shift the valve sleeve between the first plurality of indexing components and the second plurality of indexing components to selectively position the valve opening relative to the opening in the tubular.

Embodiment 2. The indexing valve system according to any prior embodiment, wherein the opening extends through the tubular between the first plurality of indexing components and the second plurality of indexing components.

Embodiment 3. The indexing valve system according to any prior embodiment, wherein the indexer includes a generally rectangular geometry.

Embodiment 4. The indexing valve system according to any prior embodiment, wherein the first plurality of indexing components include a first annular array of tooth components and the second plurality of indexing components include a second annular array of tooth components.

Embodiment 5. The indexing valve system according to any prior embodiment, wherein the first annular array of tooth components is circumferentially offset relative to the second annular array of tooth components.

Embodiment 6. The indexing valve system according to any prior embodiment, wherein each of the first plurality of indexing components and the second plurality of indexing components project radially inwardly from the inner surface portion.

Embodiment 7. The indexing valve system according to any prior embodiment, wherein the indexing step members extend annularly about and project radially inwardly from the inner surface section of the valve sleeve.

Embodiment 8. The indexing valve system according to any prior embodiment, further comprising: a passage formed in the indexing step members, the passage being receptive of the indexer.

Embodiment 9. A resource exploration and recovery system comprising: a surface system; a sub-surface system including a tubular string extending from the surface system, the tubular string including an indexing valve system comprising: a tubular including an outer surface portion, an inner surface portion defining a passage portion, a first plurality of indexing components provided on the inner surface portion and a second plurality of indexing components provided on the inner surface spaced from the first plurality of indexing components, an opening extends through the first tubular; a valve sleeve arranged in the passage portion between the first plurality of indexing components and the second plurality of indexing components, the valve sleeve including a first end having a first plurality of indexing elements that selectively engage with the first plurality of indexing components, a second end including a second plurality of indexing elements that selectively engage with the second plurality of indexing components, and an inner surface section defining a passage section, the inner surface section including a plurality of indexing step members, a valve opening extends through the valve sleeve; and an insert extending into, and being axially shiftable relative to, the passage section, the insert including an outer surface supporting an indexer that selectively engages with the plurality of indexing step members to shift the valve sleeve between the first plurality of indexing components and the second plurality of indexing components to selectively position the valve opening relative to the opening in the first tubular.

Embodiment 10. The resource exploration and recovery system according to any prior embodiment, wherein the opening extends through the first tubular between the first plurality of indexing components and the second plurality of indexing components.

Embodiment 11. The resource exploration and recovery system according to any prior embodiment, wherein the indexer includes a generally rectangular geometry.

Embodiment 12. The resource exploration and recovery system according to any prior embodiment, wherein the first plurality of indexing components include a first annular array of tooth components and the second plurality of indexing components include a second annular array of tooth components.

Embodiment 13. The resource exploration and recovery system according to any prior embodiment, wherein the first annular array of tooth components is circumferentially offset relative to the second annular array of tooth components.

Embodiment 14. The resource exploration and recovery system according to any prior embodiment, wherein each of the first plurality of indexing components and the second plurality of indexing components project radially inwardly from the inner surface portion.

Embodiment 15. The resource exploration and recovery system according to any prior embodiment, wherein the indexing step members extend annularly about and project radially inwardly from the inner surface section of the valve sleeve.

Embodiment 16. The resource exploration and recovery system according to any prior embodiment, further comprising: a passage formed in the indexing step members, the passage being receptive of the indexer.

Embodiment 17. A method of selectively opening a valve in a tubular, the method comprising: shifting an insert into a passage portion of a tubular; guiding the insert into a valve sleeve disposed in the passage portion; engaging an indexer on the insert with one of a plurality of indexing step members in the valve sleeve; shifting the valve sleeve in a first direction with the insert toward a first plurality of indexing components in the tubular; rotating the valve sleeve a first distance through inter-engagement of a first plurality of indexing elements on the valve sleeve with the first plurality of indexing components; shifting the valve sleeve in a second, opposing direction toward a second plurality of indexing elements in the tubular; engaging the second plurality of indexing elements on the valve sleeve with the second plurality of indexing components; and further rotating the valve sleeve by engaging the second plurality of indexing elements with the second plurality of indexing components.

Embodiment 18. The method according to any prior embodiment, wherein shifting the valve sleeve toward the first plurality of indexing components in the tubular includes engaging a first annular array of tooth components with a first plurality of tooth elements.

Embodiment 19. The method according to any prior embodiment, wherein rotating the valve sleeve a first distance includes moving a first plurality of angled surfaces of the plurality of tooth elements over a plurality of angled surfaces of the first plurality of indexing components.

Embodiment 20. The method according to any prior embodiment, wherein further rotating the valve sleeve includes aligning at least a portion of an opening in the tubular with a portion of a valve opening in the valve sleeve.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An indexing valve system comprising:

a tubular including an outer surface portion, an inner surface portion defining a passage portion, a first plurality of indexing components provided on the inner surface and a second plurality of indexing components provided on the inner surface portion spaced from the first plurality of indexing components, an opening extending through the tubular;

a valve sleeve arranged in the passage portion between the first plurality of indexing components and the second plurality of indexing components, the valve sleeve including a first end having a first plurality of indexing elements that selectively engage with the first plurality of indexing components, a second end including a second plurality of indexing elements that selectively engage with the second plurality of indexing components, and an inner surface section defining a passage section, the inner surface section including a plurality of indexing step members, a valve opening extends through the valve sleeve; and an insert extending into, and being axially shiftable relative to, the passage section, the insert including an outer surface supporting an indexer that selectively engages with the plurality of indexing step members to shift the valve sleeve between the first plurality of indexing components and the second plurality of indexing components to selectively position the valve opening relative to the opening in the tubular.

2. The indexing valve system according to claim 1, wherein the opening extends through the tubular between the first plurality of indexing components and the second plurality of indexing components.

3. The indexing valve system according to claim 1, wherein the indexer includes a generally rectangular geometry.

4. The indexing valve system according to claim 1, wherein the first plurality of indexing components include a first annular array of tooth components and the second plurality of indexing components include a second annular array of tooth components.

5. The indexing valve system according to claim 4, wherein the first annular array of tooth components is circumferentially offset relative to the second annular array of tooth components.

6. The indexing valve system according to claim 1, wherein each of the first plurality of indexing components and the second plurality of indexing components project radially inwardly from the inner surface portion.

7. The indexing valve system according to claim 1, wherein the plurality of indexing step members extend annularly about and project radially inwardly from the inner surface section of the valve sleeve.

8. The indexing valve system according to claim 7, further comprising: a passage formed in the indexing step members, the passage being receptive of the indexer.

9. A resource exploration and recovery system comprising:

a surface system;

a sub-surface system including a tubular string extending from the surface system, the tubular string including an indexing valve system comprising:

a tubular including an outer surface portion, an inner surface portion defining a passage portion, a first plurality of indexing components provided on the inner surface portion and a second plurality of indexing components provided on the inner surface spaced from the first plurality of indexing components, an opening extends through the first tubular;

a valve sleeve arranged in the passage portion between the first plurality of indexing components and the second plurality of indexing components, the valve sleeve including a first end having a first plurality of indexing elements that selectively engage with the first plurality of indexing components, a second end including a second plurality of indexing elements that selectively engage with the second plurality of indexing components, and an inner surface section defining a passage section, the inner surface section including a plurality of indexing step members, a valve opening extends through the valve sleeve; and an insert extending into, and being axially shiftable relative to, the passage section, the insert including an outer surface supporting an indexer that selectively engages with the plurality of indexing step members to shift the valve sleeve between the first plurality of indexing components and the second plurality of indexing components to selectively position the valve opening relative to the opening in the first tubular.

10. The resource exploration and recovery system according to claim 9, wherein the opening extends through the first tubular between the first plurality of indexing components and the second plurality of indexing components.

11. The resource exploration and recovery system according to claim 9, wherein the indexer includes a generally rectangular geometry.

12. The resource exploration and recovery system according to claim 9, wherein the first plurality of indexing components include a first annular array of tooth components and the second plurality of indexing components include a second annular array of tooth components.

13. The resource exploration and recovery system according to claim 12, wherein the first annular array of tooth components is circumferentially offset relative to the second annular array of tooth components.

14. The resource exploration and recovery system according to claim 9, wherein each of the first plurality of indexing components and the second plurality of indexing components project radially inwardly from the inner surface portion.

15. The resource exploration and recovery system according to claim 9, wherein the plurality of indexing step members extend annularly about and project radially inwardly from the inner surface section of the valve sleeve.

16. The resource exploration and recovery system according to claim 15, further comprising: a passage formed in the indexing step members, the passage being receptive of the indexer.

17. A method of selectively opening a valve in a tubular, the method comprising:

shifting an insert into a passage portion of the tubular;

guiding the insert into a valve sleeve disposed in the passage portion;

engaging an indexer on the insert with one of a plurality of indexing step members in the valve sleeve;

shifting the valve sleeve in a first direction with the insert toward a first plurality of indexing components in the tubular;

rotating the valve sleeve a first distance through interengagement of a first plurality of indexing elements on the valve sleeve with the first plurality of indexing components;

shifting the valve sleeve in a second, opposing direction toward a second plurality of indexing elements in the tubular;

engaging the second plurality of indexing elements on the valve sleeve with a second plurality of indexing components; and further rotating the valve sleeve by engaging the second plurality of indexing elements with the second plurality of indexing components.

18. The method according to claim 17, wherein shifting the valve sleeve toward the first plurality of indexing components in the tubular includes engaging a first annular array of tooth components with a first plurality of tooth elements.

19. The method of claim 18, wherein rotating the valve sleeve a first distance includes moving a first plurality of angled surfaces of the plurality of tooth elements over a plurality of angled surfaces of the first plurality of indexing components.

20. The method of claim 17, wherein further rotating the valve sleeve includes aligning at least a portion of an opening in the tubular with a portion of a valve opening in the valve sleeve.

* * * * *